US010621960B2

(12) United States Patent
Hubbert

(10) Patent No.: US 10,621,960 B2
(45) Date of Patent: Apr. 14, 2020

(54) PERCUSSIVE INSTRUMENT PRODUCING CYMATIC EFFECTS

(71) Applicant: Brooks Hubbert, Pensacola, FL (US)

(72) Inventor: Brooks Hubbert, Pensacola, FL (US)

( * ) Notice: Subject to any disclaimer, the term of this patent is extended or adjusted under 35 U.S.C. 154(b) by 0 days.

(21) Appl. No.: 16/355,423

(22) Filed: Mar. 15, 2019

(65) Prior Publication Data

US 2019/0287499 A1 Sep. 19, 2019

Related U.S. Application Data

(60) Provisional application No. 62/644,110, filed on Mar. 16, 2018.

(51) Int. Cl.
*G10D 13/08* (2020.01)
*G10D 13/02* (2020.01)

(52) U.S. Cl.
CPC ..... *G10D 13/08* (2013.01); *G10D 13/021* (2013.01); *G10D 13/027* (2013.01)

(58) Field of Classification Search
CPC .... G10D 13/08; G10D 13/021; G10D 13/027; G10D 3/02
USPC ..... 84/404
See application file for complete search history.

(56) References Cited

U.S. PATENT DOCUMENTS

| | | | | |
|---|---|---|---|---|
| 3,896,696 | A | 7/1975 | Waters | |
| 5,392,681 | A * | 2/1995 | Hall | G10D 13/023 84/413 |
| D616,017 | S * | 5/2010 | Partridge, Jr. | D17/22 |
| 8,093,477 | B1 * | 1/2012 | Twyford | G10D 13/08 84/411 R |
| 9,378,715 | B2 * | 6/2016 | Nigro | G10D 13/028 |
| 2015/0348521 | A1 * | 12/2015 | Nigro | G10D 13/026 84/421 |
| 2018/0261193 | A1 * | 9/2018 | Pond | G10D 13/021 |
| 2018/0286362 | A1 * | 10/2018 | Barnes | G10D 17/00 |

OTHER PUBLICATIONS

Brooks Hubbert, "Design U.S. Appl. No. 29/635,702", Patent Application, filed Feb. 1, 2018, 7 pages.

* cited by examiner

*Primary Examiner* — Jeffrey Donels
(74) *Attorney, Agent, or Firm* — AdamsIP, LLP; J. Hunter Adams

(57) ABSTRACT

A percussive instrument is provided. The percussive instrument includes a drum body and a plurality of tonal elements extending over a bottom surface of the drum body. The tonal elements may be struck or plucked to produce sound. The drum body includes a base and a peripheral wall extending upwardly from the base and has an open end opposite the base through which sound may be projected. The drum body may be filled with liquid to produce cymatic effects when the instrument is played and to provide an additional medium through which sound waves emitted from the tonal elements may pass over or through.

20 Claims, 5 Drawing Sheets

PERCUSSIVE INSTRUMENT PRODUCING CYMATIC EFFECTS

CROSS-REFERENCE TO RELATED APPLICATIONS

This application claims priority to U.S. Provisional Patent Application Ser. No. 62/644,110 filed on Mar. 16, 2018, the entirety of which is incorporated herein by reference.

FIELD OF THE DISCLOSURE

The subject matter of the present disclosure relates generally to a musical instrument, and more specifically to a percussive idiophone which may be combined with water to produce cymatic effects when struck.

BACKGROUND

Drums are percussion-based musical instruments that produce sound when struck. The sound elicited from drums and other percussive instruments is often utilized to create or contribute to the rhythmic section of musical compositions. Accordingly, drums are a central feature of many musical groups' and solo artists' musical acts. Traditionally, drums have existed as membranophones, i.e., musical instruments which produce sound primarily by way of vibrating a stretched membrane. As such, many known drums often comprise at least one membrane, commonly referred to as a "drum head" or "skin", stretched over a hollowed shell. Often times, the drum head is secured in relation to an open end of the shell by way of a tension ring, commonly referred to as a "hoop" or "rim", that is positioned over the drum head and which may be drawn downwardly toward the shell using one or more tension screws or other tightening mechanisms. By tightening the tension screws the drum head is stretched and the tension of the drum head is increased, thereby producing a higher pitched sound when struck. Conversely, by loosening the tension screws the drum head draws inwardly upon itself such that the tension of the drum head is decreased, thereby producing a lower pitched sound when struck. For some drums, such as djembes, the tension of a drum head may be increased or decreased by other tightening mechanisms, such as rope, however, the pitch of such drums is affected in the same manner as those with tightening screws. Accordingly, for traditional drums, the pitch of the sound emitted from a drumhead when struck is generally dependent upon the extent to which the drum head is stretched over the shell, and thus can only be altered by increasing or decreasing the tension of the drum head. In turn, as the tension of a drum head is generally manipulated by tightening or loosening the tightening mechanism of the drum, the pitch of sound elicited from the drumhead cannot be readily manipulated while the drum is being played.

A variety of non-membranophone drums, such as steel or wooden tongue drums, are known. The pitches of sound exhibited by such instruments, however, generally cannot be manipulated because the tonal elements that produce sound when struck are embedded in a fixed position within the instrument's body. U.S. Pat. No. 3,896,696 to Richard A. Water discloses a tonal percussive instrument, more colloquially referred to as a "waterphone", that can utilize water movement to affect the pitch of the sounds produced thereby when struck or bowed. Water is generally introduced into waterphones by pouring a desired amount of water in through an elongated neck and into a resonator chamber such that the water pools at the base of the chamber. In waterphones, the resonator chamber is enclosed except for a small aperture that provides passage from the instrument's neck to the resonator chamber. As such, the water contained within the resonator chamber is not generally visible.

Cymatics is the process of making sound waves visible. In cymatics, the visualization of sound may be achieved by vibrating a surface on which a deformable medium, such as water, is disposed. As the surface vibrates, regions of the surface exhibiting maximum and minimum displacement are made visible by the deforming medium. Depending on the nature of the vibration exhibited by the surface, the deformable medium may form visually pleasing designs or patterns which, in some instances, may cause observers thereof to experience feelings of calm. Although the water utilized within waterphones may sometimes be deformed in response to vibrations created during the playing thereof, the patterns and designs resulting from such deformities are not visible due to the generally closed design of the waterphone.

New apparatuses, systems, kits, and methods for a percussive instrument that permits users to view the patterns or designs exhibited by a deformable medium contained therein and that enables users to vary the pitch of sound elicited from the instrument during the playing thereof are described herein.

SUMMARY

In one aspect, a percussive instrument is provided. The percussive instrument generally comprises a drum body defined by a base having a peripheral wall extending upwardly therefrom and a plurality of tonal elements which may be struck or plucked to produce sound. The drum body includes an open end opposite the base to permit sound elicited from the tonal elements to escape into the surrounding environment. Each tonal element may be secured proximate to the drum body's open end and extend over the bottom surface of the drum body. To vary the frequency of vibration experienced by, and thus the pitch of sound elicited from, each tonal element when struck or plucked, the length of some or all of the tonal elements may vary. Accordingly, the lengths of the tonal elements may be selected so that each will vibrate at a predetermined frequency so that any desired scale of frequencies may be attained.

In response to being struck or plucked, the tonal elements vibrate to produce audible sound waves. Vibration of the tonal elements may cause vibration within the drum body. Liquids may be introduced into the drum body via its open end to pool on the bottom surface of the drum body. Vibration of the drum body may cause the pooled liquid to deform in accordance with such vibration, thereby producing patterns or designs within the liquid viewable to users via the open end of the drum body. As various tonal elements may vibrate at different frequencies, the vibrations experienced by the drum body, and thus patterns or designs within the pooled liquid, may also vary depending on which tonal elements are struck or plucked.

Liquid may also be introduced into the drum body to provide a secondary medium—in addition to a first medium of air—through which the sound waves emitted from the tonal elements may pass over or through. As the sound waves pass from the first medium of air to or over the second medium of liquid, refraction of the sound waves may occur causing the directional path and wavelength of the sound waves produced by the tonal elements to change. While playing the instrument, users may move the drum body to affect the pooling location of the liquid and alter the pitch of sound elicited from the tonal elements while actively playing the instrument.

The foregoing summary has outlined some features of the apparatus of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the apparatus, system, and methods disclosed herein. Those skilled in the pertinent art should also realize that such equivalent designs or modifications do not depart from the scope of the device and the methods of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. The term "removably secured" and grammatical equivalents thereof are used herein to mean the joining of two components in a manner such that the two components are secured together, but may be detached from one another and re-secured together without requiring the use of specialized tools.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Turning now to the drawings, FIGS. 1-6C illustrate a percussive instrument 100 according to one embodiment of the present disclosure. While the instrument 100 of the present disclosure is sometimes described in the context of being combined with a liquid 300, those skilled in the art will appreciate that the instrument 100, in its various embodiments, disclosed herein may have other substances or no substances placed therein and still be utilized as a musical instrument.

Figure 1:
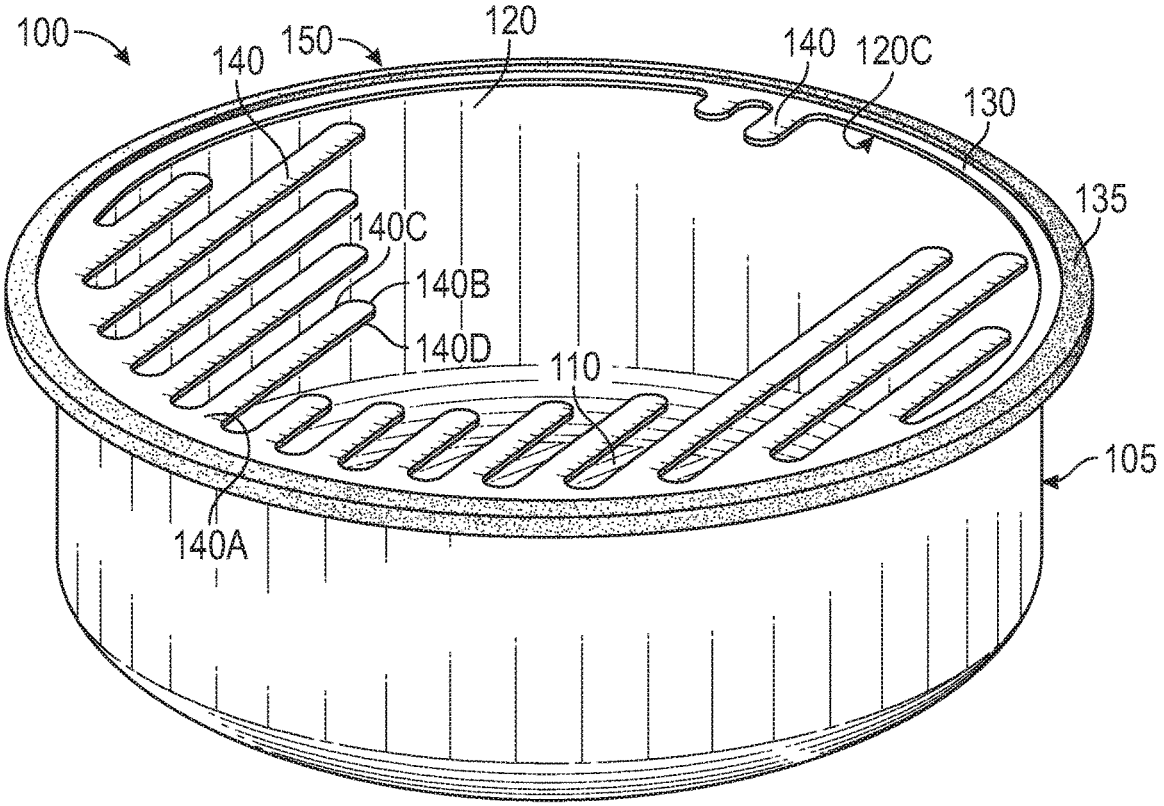
FIG. 1 shows a front perspective view of an instrument embodying features consistent with the principles of the present disclosure.
Figure 2:
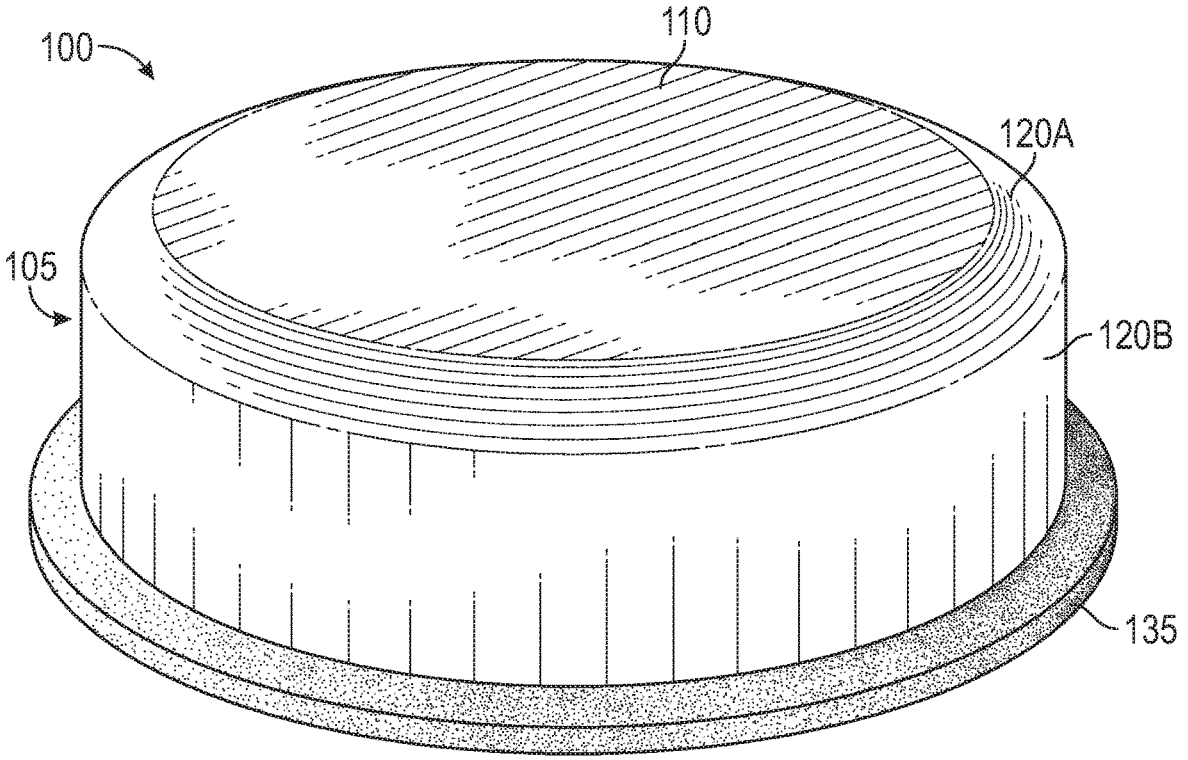
FIG. 2 shows a bottom perspective view of an instrument embodying features consistent with the principles of the present disclosure.
Figure 3:
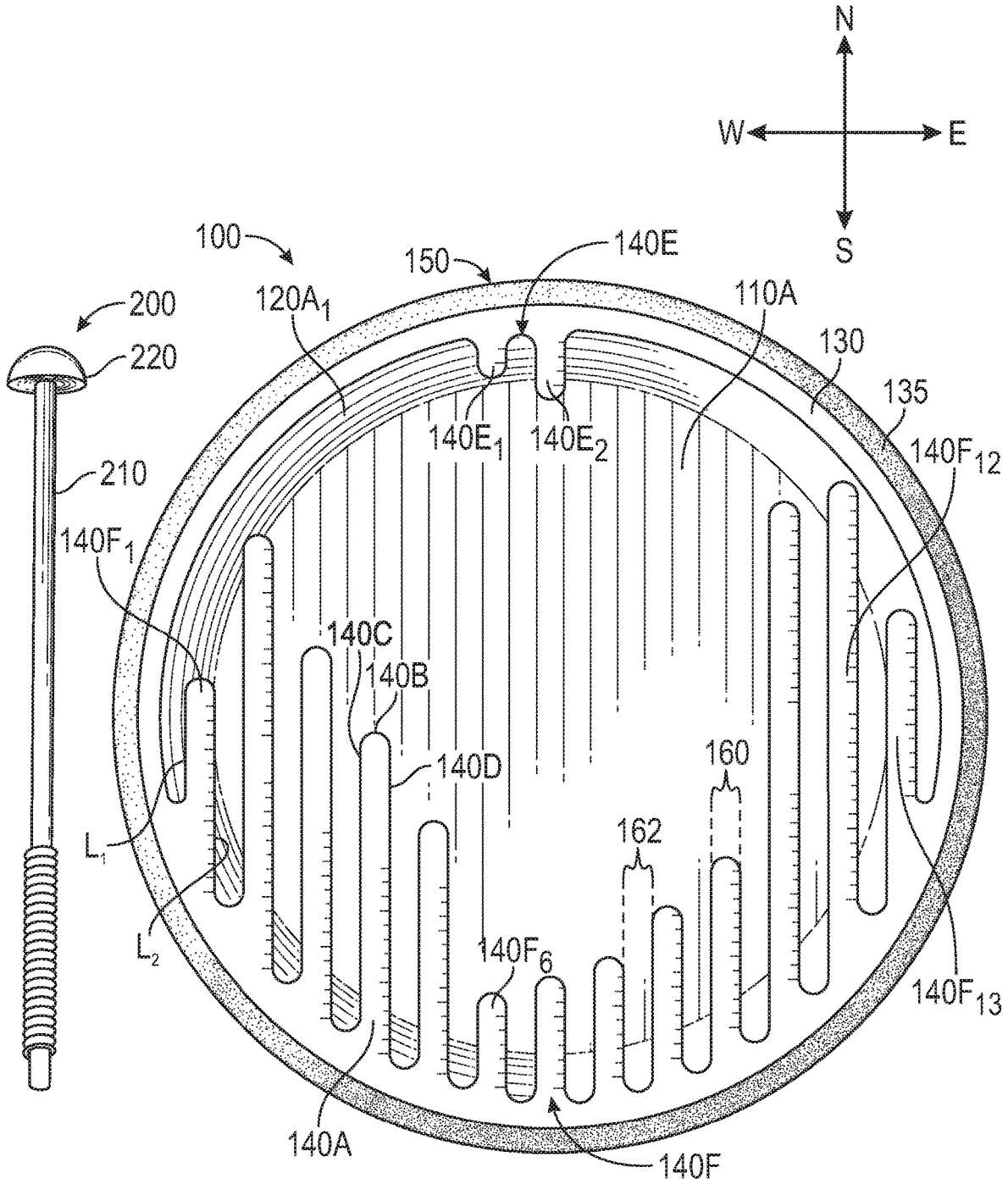
FIG. 3 shows a top view of a kit embodying features consistent with the principles of the present disclosure.
Figure 4:
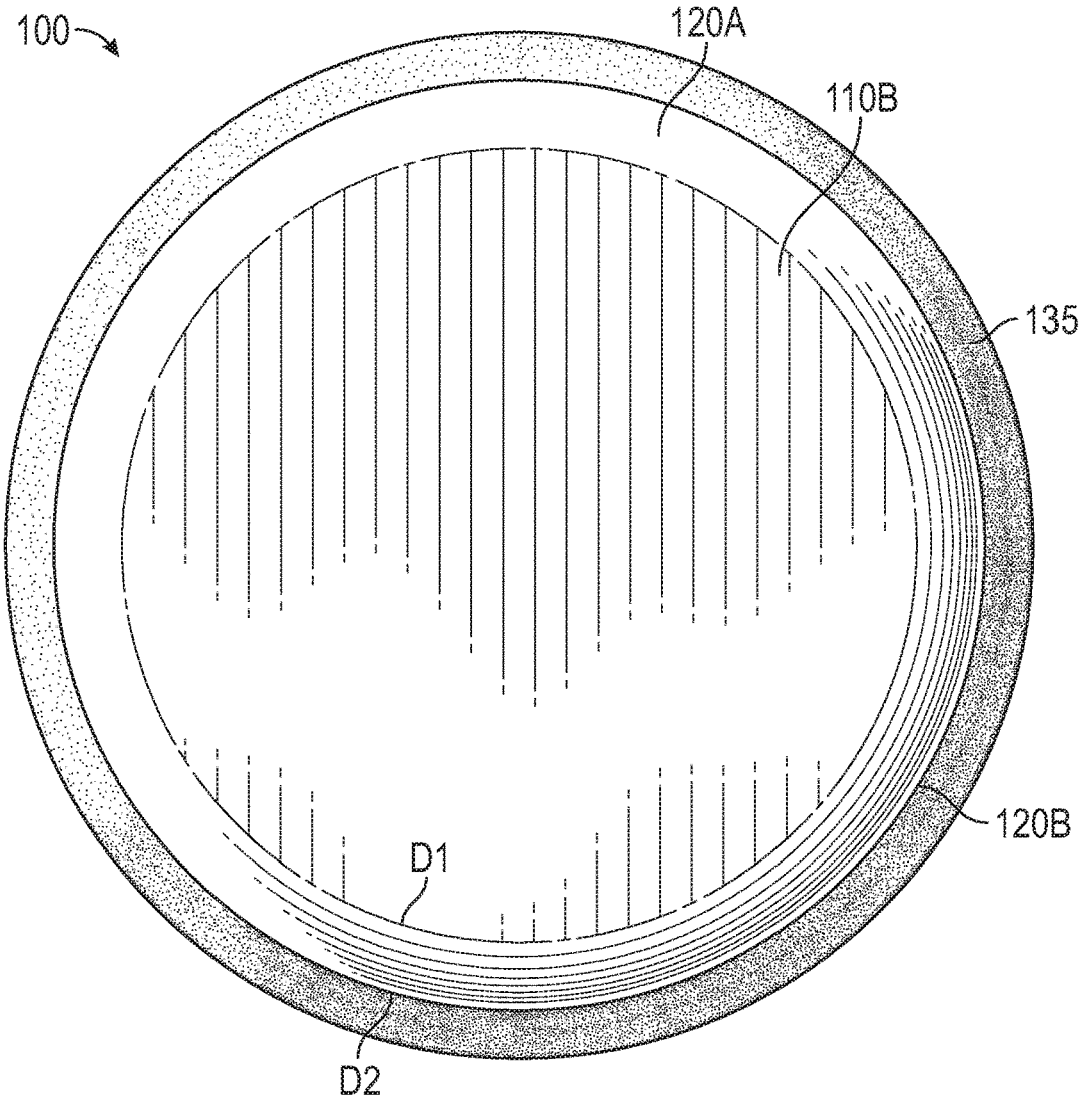
FIG. 4 is a bottom view of an instrument embodying features consistent with the principles of the present disclosure.

The instrument 100 includes a drum body 105 and a plurality of tonal elements 140. The drum body 105 is defined by a base 110 and a peripheral wall 120 extending upwardly from the base 110. In an embodiment, the drum body 105 may be integrally formed such that the base 110 and peripheral wall 120 are permanently joined together to form a single component of the instrument 100. In other embodiments, the base 110 and peripheral wall 120 may be separate components that are removably secured together to form the drum body 105. In some embodiments, the base 110 and peripheral wall 120 may each retain a generally annular shape so that the drum body 105 forms a cylinder having an open end 150 and an opposite closed end, as shown best in FIGS. 1-2, 4, and 6A-6C. The base 110 and peripheral wall 120 may, however, be alternatively shaped in other embodiments. For instance, in alternative embodiments, the base 110 and peripheral wall 120 may each retain a generally triangular or quadrilateral shape. As shown in FIGS. 2-4, the base 110 may be substantially flat in some embodiments to promote uniform pooling of liquid 300 introduced into the drum body's 105 interior. In other embodiments, the base 110 may have one or more depressions or protuberances formed therein to influence the manner in which liquid 300 pools across the drum body 105.

Figure 5:
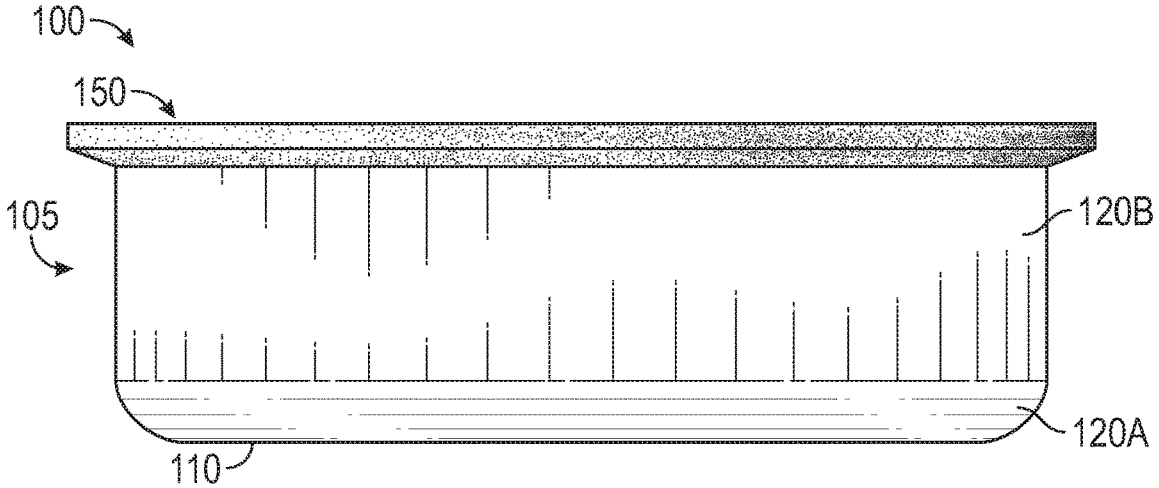
FIG. 5 is a side view of an instrument embodying features consistent with the principles of the present disclosure.

As shown best in FIGS. 2 and 5, in an embodiment, the peripheral wall 120 is defined by a curved portion 120A and a straight portion 120B. The uppermost portion of the peripheral wall 120 (the portion of the peripheral wall 120 positioned furthest from the base 110) may, in some embodiments, define a rim 120C to which certain components of the instrument 100 described herein may be secured. The curved portion 120A of the peripheral wall 120 extends outwardly and upwardly from the base 110 and the straight portion 120B of the peripheral wall 120 extends upwardly from the curved portion 120A, as further shown in FIGS. 2 and 5. Accordingly, in some embodiments, the curved portion 120A may serve to interconnect the straight portion 120B and the base 110 of the drum body 105. The outermost portion of the base 110 defines a first diameter $D_1$ and the straight portion 120B of the peripheral wall 120 defines a second diameter $D_2$. In embodiments where the curved portion 120A extends outwardly from the base 110, the second diameter $D_2$ defined by the straight portion 120B of the peripheral wall 120 may be greater than the first diameter $D_1$ defined by the base 110, as best shown in FIG. 4. During use of the instrument 100, the curved portion 120A may enable liquids 300 to smoothly transition from the base 110 to the peripheral wall 120 in instances where the instrument 100 is tilted or shaken, thereby reducing the amount of liquid 300 splashed up or projected out of the instrument 100 during such movement of the instrument 100.

In other embodiments, the peripheral wall 120 may be devoid of a curved portion and comprise only a straight portion 120B such that the peripheral wall 120 extends straight up from the base 110. In such embodiments, the first diameter $D_1$ defined by the base 110 and a the second diameter $D_2$ defined by the peripheral wall 120 are substantially equal. In yet another embodiment, the peripheral wall 120 may comprise only a straight portion 120B that extends from the base 110 in a manner such that the base 110 and peripheral wall 120 form an obtuse or acute angle.

In an embodiment, the drum body 105 is constructed, at least partially, of a metal material. In one such embodiment, the drum body 105 is constructed of a noncorrosive or corrosion-resistant material, such as stainless steel, chrome, aluminum, and the like to prevent rust or other deterioration of the drum body 105. In other embodiments, other materials such as wood, plastic, combinations thereof, or any other material suitable for the applications described herein may be utilized in the construction of the drum body 105. In some embodiments, the drum body 105 may be constructed so that the base 110, or at least a portion thereof, is flexible or semiflexible and acts as a diaphragm when the instrument 100 is played.

Each tonal element within the plurality of tonal elements 140 is configured to vibrate at a frequency within the range of audible frequencies for humans when struck or plucked. Each tonal element within the plurality of tonal elements 140 extends over a portion of a bottom surface of the drum body 105 and has a fixed first end 140A and a free second end 140B. As used herein, the "bottom surface of the drum body" may include the interior surface of the base 110A alone or, as shown best in FIG. 3, both the interior surface of the base 110A and the interior surface of the peripheral wall's curved portion $120A_1$, depending on the manner in which the peripheral wall 120 is constructed. That is, in embodiments where the peripheral wall 120 is devoid of a curved portion 120A, the bottom surface of the drum body includes only the interior surface of the base 110A and, in embodiments where the peripheral wall 120 includes a curved portion 120A, the bottom surface of the drum body includes both the interior surface of the base 110A and the interior surface of the curved portion $120A_1$. To allow users to easily view the majority of the drum body's 105 interior and any liquid 300 contained therein while playing the instrument 100, the portions of the bottom surface of the drum body 105 over which the plurality of tonal elements 140 extend (i.e., the portions of the bottom surface of the drum body 105 visually obstructed by the plurality of tonal elements 140 when viewing the instrument 100 from a top view over its open end 150) may collectively define a surface area that is less than half of the total surface are of the bottom surface of the drum body 105, as shown best in FIG. 3.

In one embodiment, the plurality of tonal elements 140 are formed within a single plate 130 such that each tonal element of the plurality of tonal elements 140 represents a portion of the plate 130 that was not cut and subsequently removed during manufacture. In an embodiment, the plate 130 is constructed, at least partially, of a metal material. To prevent rust or other deterioration of the plate 130, the plate 130 may, in some embodiments, be constructed of a non-corrosive or corrosion resistant material, such as stainless steel, chrome, aluminum, and the like. In other embodiments, other materials such as wood, plastic, combinations thereof, or any other material suitable for the applications described herein may be utilized for the plate 130. In some embodiments, the plurality of tonal elements 140 may be formed within the plate 130 via laser cutting or water jet cutting a metal plate. The diameter of the plate 130 is equal to or greater than the diameter of the rim 120C of the peripheral wall 120 so that the plate 130 can be disposed on top of and be secured to the rim 120C of the peripheral wall 120, as shown best in FIG. 1. The plate 130 may be permanently secured to the rim 120C of the peripheral wall 120 via welding, the use of adhesives, or other suitable methods for joining two objects in a substantially permanent manner. In alternative embodiments, the plate 130 may be removably secured to the rim 120C of the peripheral wall 120 using any suitable fastener or fasteners configured to removably secure two objects together.

In other embodiments, each tonal element of the plurality of tonal elements 140 may comprise an individual member that is separate from and unconnected to the other tonal elements. In such embodiments, the first end 140A of each tonal element may be secured to the peripheral wall 120 such that each tonal element is generally perpendicular to the peripheral wall 120 at the point of attachment and extends inwardly towards the center of the drum body 105. In one such embodiment, the first end 140A of each tonal element may be secured to the rim 120C of the peripheral wall 120.

As shown best in FIG. 3, in an embodiment, at least the second end 140B of one or more of the tonal elements within the plurality of tonal elements 140 extends substantially parallel to the interior surface of the base 110A when the instrument 100 is assembled to enhance the extent in which sound waves emitted from the vibration of those tonal elements are resonated by the drum body 105. In some embodiments, the second end 140B of each tonal element is disposed generally parallel to the base's interior surface 110A. In an embodiment, the width 160 of the second end 140B of at least two tonal elements within the plurality of tonal elements are equal. In one such embodiment, the width 160 of the second end 140B of all tonal elements within the plurality of tonal elements 140 are equal, as shown best in FIG. 3. In one embodiment, the second end 140B of each tonal element may be rounded. Alternatively, the second end 140B of each tonal element may be pointed or squared.

When the instrument 100 is assembled, each tonal element of the plurality of tonal elements 140 is preferably secured proximate to the drum body's 105 open end 150. In some embodiments, the tonal elements may be arranged such that the plurality of tonal elements 140 are disposed along the same horizontal plane so that the plurality of tonal elements 140 are disposed at the same height above the bottom surface of the drum body 105. Alternatively, the tonal elements may be disposed at different heights about the plate 130 or secured at different heights about the peripheral wall 120. As shown by at least tonal elements $140F_{12}$ and $140F_{13}$ in FIG. 3, the plurality of tonal elements 140 may, in some embodiments, be arranged so that at least two tonal elements extend parallel to each other.

Each tonal element has a first side 140C and a second side 140D. As shown in FIGS. 1, 3, and 6A-6C, the first and second side 140C, 140D of each tonal element may, in some embodiments, extend parallel to each other. The first side 140C and the second side 140D may be the same length or, as shown in FIGS. 1 and 3, be of different lengths. In one embodiment, the plurality of tonal elements 140 includes at least one tonal element having a first side 140C of a first length $L_1$ and a second side 140D of a second length $L_2$ that is different than the first length $L_1$. For instance, as shown in FIG. 3, tonal element 140$F_1$ has a first side 140C with a first length $L_1$ that is less than a second length $L_2$ defined by tonal element's 140$F_1$ second side 140D. In some embodiments, the length of each tonal element's first and second side 140C, 140D is different. To vary the sounds that can be elicited from the instrument 100, the length extending from the first end 140A to the second end 140B of a tonal element may vary across the plurality of tonal elements 140. In some embodiments, some or all of the tonal elements within the plurality of tonal elements may be elongated. Longer tonal elements will vibrate at a lower frequency when struck or plucked and thus emit a lower pitch of sound while shorter tonal elements will vibrate at a higher frequency when struck or plucked and emit a higher pitch of sound. Accordingly, the lengths of the tonal elements may be selected so that each will vibrate at a predetermined frequency so that any desired scale of frequencies, and thus pitches of sound, may be attained. In an embodiment, each tonal element has a different length than the other tonal elements within the plurality of tonal elements 140. In other embodiments, some or all of tonal elements may have the same length. One of skill in the art will appreciate the number, shape, location about the plate 130 and/or peripheral wall 120, and arrangement of tonal elements within the instrument 100 may vary from that shown within the figures and still fall within the scope of the present disclosure.

In some embodiments, the tonal elements within the plurality of tonal elements 140 may be divided into separate sets, where each set is secured at a different locations around the instrument 100. For instance, as shown in FIGS. 1 and 3, the plurality of tonal elements 140 may be divided into a first set 140E comprising two tonal elements 140$E_1$, 140$E_2$ and a second set 140F comprising thirteen tonal elements 140$F_1$-140$F_{13}$. To prevent unnecessary crowding of the drawings, only the first 140$F_1$, sixth 140$F_6$, twelfth 140$F_{12}$, and thirteenth 140$F_{13}$ tonal elements of the second set 140F are provided with reference numbers in FIG. 3. The foregoing example provides but one example as to how the tonal elements may be divided into and secured as separate sets, and one of skill in the art will readily appreciate that the tonal elements may be divided into any number of sets and that each set may comprise more or less tonal elements than either set 140E, 140F of the above example.

As further shown in FIGS. 1 and 3, each tonal element within a respective set 140E, 140F of tonal elements may extend in the same direction as the other tonal elements within the set. For instance, in the embodiment provided in FIG. 3, tonal elements 140$E_1$ and 140$E_2$, defining the first set 140E of tonal elements, extend from their first end 140A to their second end 140B in a north-to-south direction and tonal elements 140$F_1$-140$F_{13}$, defining the second set 140F of tonal elements, extend from their first end 140A to their second end 140B in a south-to-north direction. Accordingly, in some embodiments, the instrument 100 may include a first set 140E of tonal elements that extends towards a second set 140F of tonal elements or two sets 140E, 140F of tonal elements that extend towards each other. To provide increased visibility of the drum body's 105 interior while playing the instrument 100, each tonal element within a set 140E, 140F of tonal elements may be separated by a spacing 162. In one embodiment, the spacing 162 between adjacent tonal elements within a set may be equal to the width 160 of one of the tonal element's second end 140B. In embodiments, where the width 160 of the second end 140B of all tonal elements within the plurality of tonal elements 140 is equal, the spacing 162 between all adjacent tonal elements within a set 140E, 140F of tonal elements may be equal to width 160, as further shown in FIG. 3.

In some embodiments, the instrument 100 may further comprise a protective guard 135. The protective guard 135 may act as a shock absorber to prevent the drum body 105 or plurality of tonal elements 140 from bending or otherwise deforming in instances where the instrument 100 is dropped or is otherwise subjected to strenuous forces. To this end, the protective guard 135 may be constructed, at least partially, of a rubber or plastic material. Alternatively, the protective guard 135 may be constructed, at least partially, of wood or any other suitable material. In some embodiments, the protective guard 135 may be designed to cover the entirety of the instrument's 100 exterior. In other embodiments, as shown in FIGS. 1-6A, the protective guard 135 may be designed to cover only the instrument's 100 outermost exterior surface. In one such embodiment, the protective guard 135 may be secured to the drum body 105 and/or plate 130 to cover the outer edge of the plate 130. In some instances, where the instrument 100 includes a plate 130 secured to the rim 120C of the peripheral wall 120, the protective guard 135 may serve to hide the welds or other fasteners securing the plate 130 to the peripheral wall 120. The protective guard 135 may have a channel formed therein to receive the rim of the peripheral wall 120 and/or outer perimeter of the plate 130.

Figure 6A:
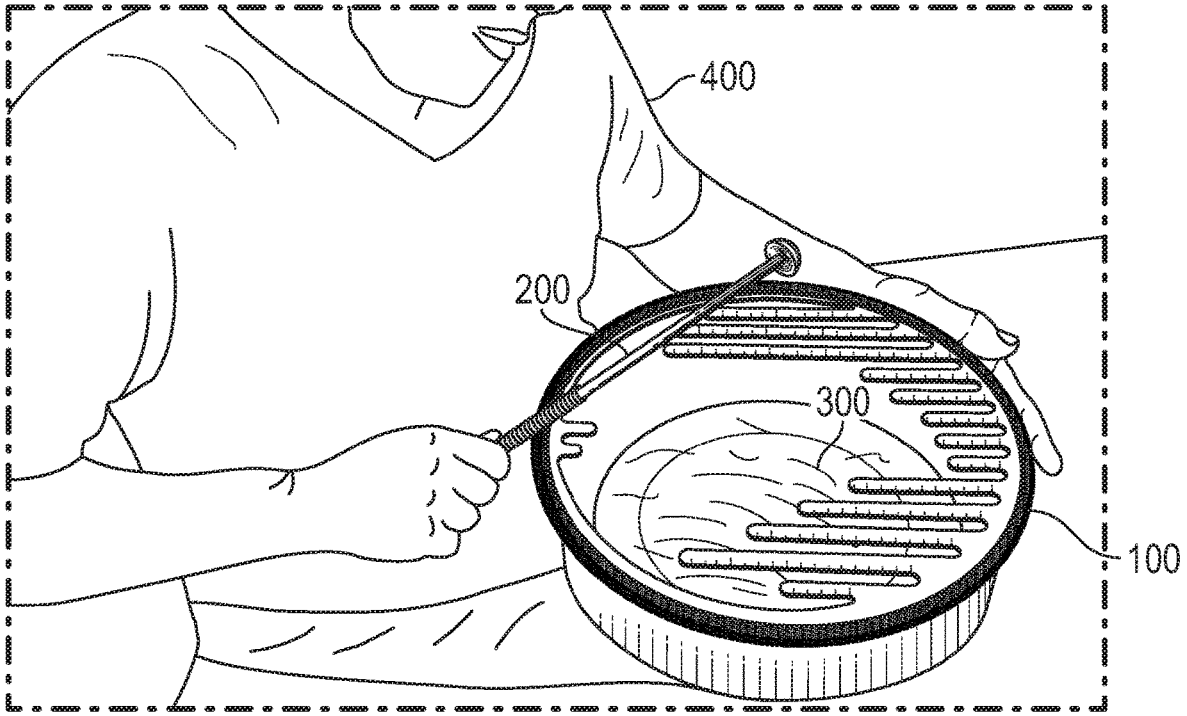
FIG. 6A is a perspective view of a user preparing to strike an instrument embodying features consistent with the principles of the present disclosure with a mallet embodying features consistent with the principles of the present disclosure.
Figure 6B:
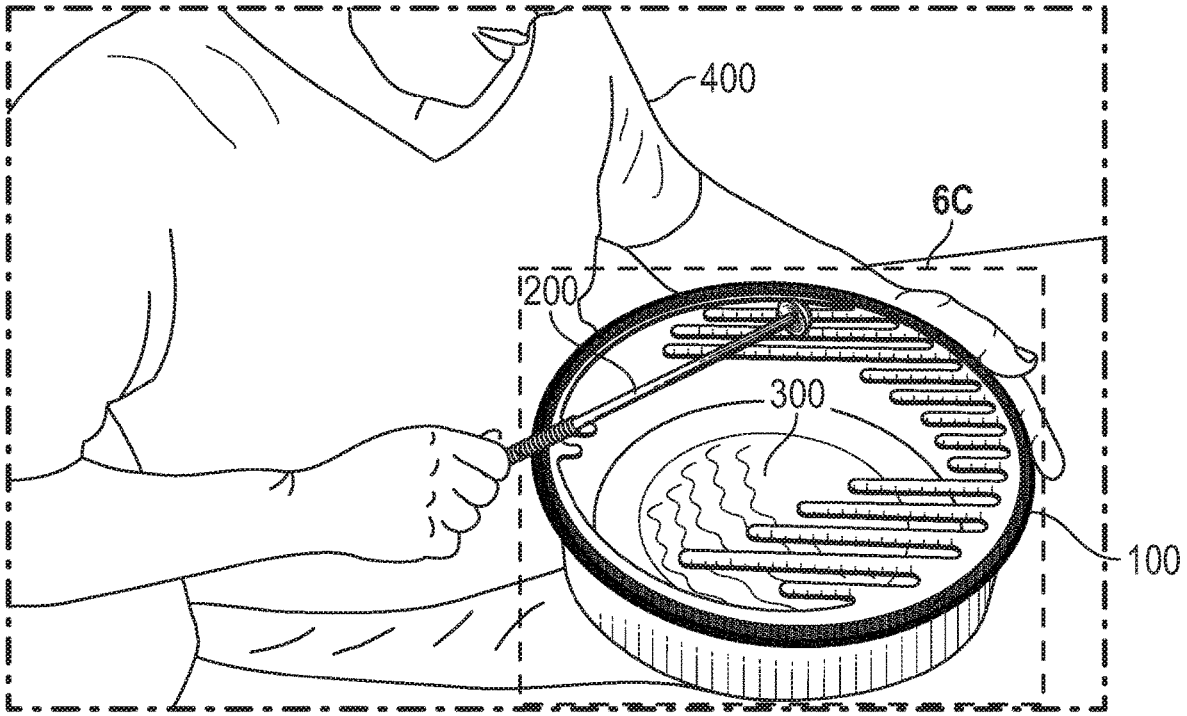
FIG. 6B is a perspective view of a user striking an instrument embodying features consistent with the principles of the present disclosure with a mallet embodying features consistent with the principles of the present disclosure.
Figure 6C:
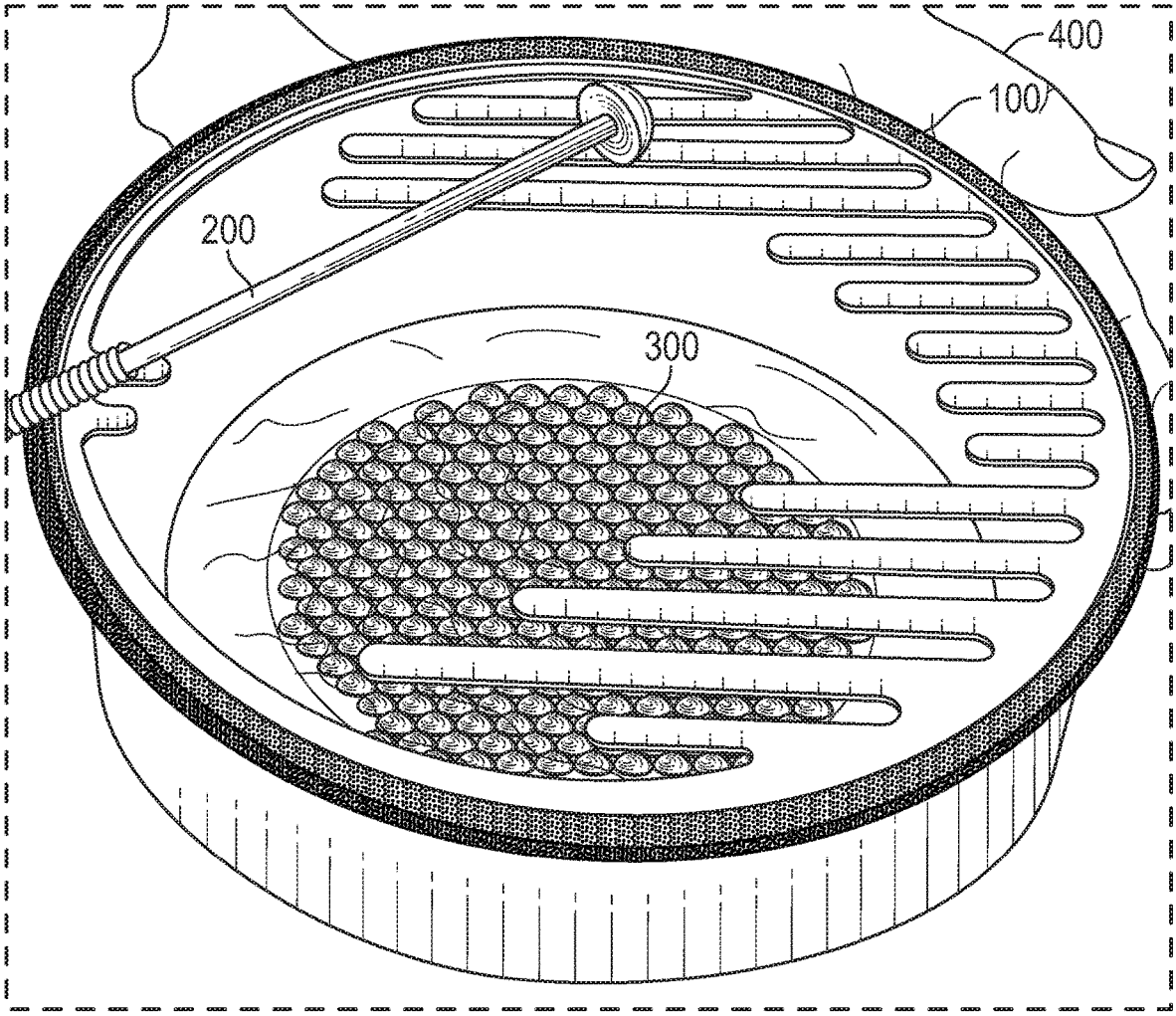
FIG. 6C is a magnified view of the instrument and mallet shown in FIG. 6B.

FIGS. 6A-6C show a user 400 playing the instrument 100 of the present disclosure. The instrument 100 may be played by striking the tonal elements 140 with a mallet 200 or, alternatively, by plucking the plurality of tonal elements 140 by hand. Accordingly, in another aspect, the present disclosure is directed to a drumming kit including the percussive instrument 100 disclosed herein and a mallet 200, as shown in FIG. 3. As further shown in FIG. 3, the mallet 200 may comprise a handle 210 and a mallet head 220. The mallet head 220 may be sized and shaped such that a single tonal element may be struck thereby without also striking adjacent tonal elements. Mallets 200 which may be used to play the instrument 100 of the present disclosure include, but are not limited to, superball mallets, as shown in FIGS. 3 and 6A-6B, timpani mallets, vibe and marimba mallets, glock or xylophone mallets, bass drum mallets, gong or tam-tam beaters, tubular bell or chime mallets, or the like. In response to being struck or plucked, a tonal element will vibrate, thereby producing audible sound waves. The pitch of sound exhibited by the soundwave is dependent upon the frequency of vibration experienced by the affected tonal element. As such, tonal elements having a shorter length will have a greater frequency of vibration and have a higher pitched sound when struck or plucked, whereas tonal elements having a longer length will vibrate at a less rapid frequency and have a lower pitched sound when struck or plucked.

Prior to playing the instrument 100, liquid 300, such as water, may be introduced into the interior of the drum body 105, as shown in FIGS. 6A-6B. Accordingly, in some embodiments, the instrument 100 may further comprise a liquid 300. Liquid 300 may be introduced into the container body 105 by pouring the liquid through the open end 150 of the drum body 105 such that the liquid 300 pools on the bottom surface of the drum body 105. As shown in FIG. 6A, prior to striking or plucking the tonal elements 140, the liquid 300 may be pooled and unmoving within the drum body 105. Vibration of one or more tonal elements within the plurality of tonal elements 140 may cause the drum body 105, or components thereof, to vibrate. In some embodiments, the base 110 of the drum body 105 may be configured to sympathetically vibrate in response the vibration of one or more tonal elements. Vibration of one or more components of the drum body 105 resulting from the striking or plucking of one or more tonal elements may cause the liquid 300 disposed within the drum body 105 to bubble, ripple, or otherwise deform, thereby producing visual patterns or designs within the liquid 300 viewable to users 400 through the drum body's 105 open end 150, as shown in FIGS. 6B-6C. In this way, the instrument 100 may be combined with liquid 300 to produce cymatic effects when played.

The drum body 105 may be filled within any volume of liquid 300, though the vibrational effect of the drum body 105, and specifically vibration of the base 110, on the liquid 300 may be most discernable when the volume of liquid 300 is such that the base 110 is partially covered or just barely completely covered. As the various tonal elements may vibrate at different frequencies, the vibrations experienced by the drum body 105, and thus patterns or designs within the liquid 300 contained therein, may also vary depending on which tonal elements are struck or plucked. Accordingly, striking or plucking the various tonal elements 140 may cause some of the liquid 300, as shown in FIG. 6C, or all of the liquid 300 contained within the drum body 105 to ripple, bubble, or otherwise deform.

In addition to providing visual patterns or designs, introducing a liquid 300 into the drum body 105 may serve to provide an additional medium through which the sound waves emitted from the tonal elements may pass. When the instrument 100 is played without liquid 300, the sound waves emitted by the striking or plucking of the tonal elements pass through air alone, whereas the sound waves may pass through two mediums when liquid 300 is present in the drum body 105. Because the refractive index of air and a liquid 300, such as water, are generally different, the sound waves may be refracted such that that directional path and wavelength of the sound waves change as they pass from the air to liquid 300, thereby altering the pitch of the sound wave. Depending on the refractive index of the liquid 300 used, the extent to which the sound waves are refracted may vary. By rotating or tilting the drum body 105, users 400 may influence the location at which the liquid 300 pools within the drum body 105. Accordingly, by moving the drum body 105 users 400 may influence the extent to which sound waves emitted from struck or plucked tonal elements 140 pass through the liquid 300. In this way, users 400 may alter the pitch or otherwise affect the sound elicited from the tonal elements while actively playing the instrument 100.

It is understood that versions of the inventive subject matter of the present disclosure may come in different forms and embodiments. Additionally, it is understood that one of skill in the art would appreciate these various forms and embodiments as falling within the scope of the inventive subject matter disclosed herein.

What is claimed is:

1. A percussive instrument, comprising:

a drum body having an open end for receiving liquid therein, a base opposite the open end, and a peripheral wall extending upwardly from the base; and a plurality of tonal elements secured proximate the open end and extending over a bottom surface of the drum body.

2. The percussive instrument of claim 1, wherein the peripheral wall has a first portion having a diameter greater than the diameter of the base and a second portion interconnecting the first portion and the base.

3. The percussive instrument of claim 1, wherein at least one tonal element within the plurality of tonal elements has a first side of a first length and a second side of a second length different than the first length.

4. The percussive instrument of claim 1, wherein each tonal element within the plurality of tonal elements has a first side and a second side extending parallel to the first side.

5. The percussive instrument of claim 1, wherein the plurality of tonal elements are formed within a single plate secured to the peripheral wall.

6. The percussive instrument of claim 1, wherein the plurality of tonal elements includes a first tonal element extending parallel to a second tonal element.

7. The percussive instrument of claim 1, wherein the plurality of tonal elements comprises a first set of tonal elements and a second set of tonal elements, and wherein the tonal elements of the first set extend towards the tonal elements of the second set.

8. The percussive instrument of claim 1, wherein each tonal element of the plurality of tonal elements has a fixed first end and a free second end having a width, and wherein the width of the second end of at least two tonal elements within the plurality of tonal elements are equal.

9. The percussive instrument of claim 8, wherein the plurality of tonal elements includes a first tonal element and a second tonal element separated by a spacing equal to the width of the first tonal element's second end.

10. The percussive instrument of claim 1, wherein the plurality of tonal elements are of different lengths.

11. The percussive instrument of claim 1, further comprising a protective guard covering at least a portion of the percussive instrument's exterior surface.

12. A percussive instrument, comprising:

an integrally formed drum body defined by a base and a peripheral wall extending upwardly from the base, the drum body having an open end opposite the base for receiving a liquid therein; and a plurality of tonal elements secured proximate the open end and extending over one or more portions of a bottom surface of the drum body.

13. The percussive instrument of claim 12, wherein the surface area of the one or more portions of the bottom surface is less than half of the total surface area of the bottom surface.

14. The percussive instrument of claim 12, wherein the plurality of tonal elements are disposed at the same height over the bottom surface.

15. The percussive instrument of claim 12, wherein the plurality of tonal elements includes at least one set of tonal elements, and wherein each tonal element within a set of the at least one set of tonal elements extends in the same direction as the other tonal elements within the set.

16. The percussive instrument of claim 12, wherein each tonal element of the plurality of tonal elements has a fixed first end and a free second end having a width, the width of each second end within the plurality of tonal elements being equal.

17. The percussive instrument of claim 16, wherein the plurality of tonal elements includes at least one set of tonal elements, and wherein a spacing exists between adjacent tonal elements within each set of the at least one set of tonal elements, the spacing being equal to the width.

18. The percussive instrument of claim 12, wherein the peripheral wall has a first portion having a diameter greater than the diameter of the base and a curved second portion interconnecting the first portion and the base.

19. The percussive instrument of claim 12, wherein the drum body comprises metal.

20. The percussive instrument of claim 12, further comprising the liquid disposed within an interior of the drum body.

* * * * *